US006370843B1

(12) United States Patent
Bercaits et al.

(10) Patent No.: US 6,370,843 B1
(45) Date of Patent: Apr. 16, 2002

(54) STORING PIECES CUT OUT FROM A LAY-UP

(75) Inventors: Jean-Louis Bercaits, Canejan; Régis Lallement, Cestas, both of (FR)

(73) Assignee: Lectra Systemes (FR)

( * ) Notice: Subject to any disclaimer, the term of this patent is extended or adjusted under 35 U.S.C. 154(b) by 0 days.

(21) Appl. No.: 09/367,773

(22) PCT Filed: Feb. 20, 1998

(86) PCT No.: PCT/FR98/00332

§ 371 Date: Sep. 10, 1999

§ 102(e) Date: Sep. 10, 1999

(87) PCT Pub. No.: WO98/36971

PCT Pub. Date: Aug. 27, 1998

(30) Foreign Application Priority Data

Feb. 20, 1997 (FR) ..... 97 02002

(51) Int. Cl.[7] ..... B65B 1/24
(52) U.S. Cl. ..... 53/436
(58) Field of Search ..... 53/405, 429, 432, 53/436, 447, 450, 466, 477, 510, 526, 550, 131.3; 383/109, 37; 206/524.8

(56) References Cited

U.S. PATENT DOCUMENTS

| | | | | | |
|---|---|---|---|---|---|
| 3,499,261 | A | * | 3/1970 | Hullhorst et al. | 53/436 |
| 3,848,490 | A | | 11/1974 | Arel | |
| 4,377,061 | A | * | 3/1983 | Olsen et al. | 53/433 |
| 4,514,246 | A | | 4/1985 | Forrer et al. | |
| 4,711,067 | A | | 12/1987 | Magni | |
| 4,757,669 | A | * | 7/1988 | Areblom et al. | 53/512 |
| 5,092,829 | A | | 3/1992 | Gerber | |
| 5,195,300 | A | * | 3/1993 | Kovacs et al. | 53/438 |
| 5,230,765 | A | | 7/1993 | Weisefish et al. | |
| 5,603,284 | A | * | 2/1997 | Freedman | 53/436 |
| 5,832,696 | A | * | 11/1998 | Nagy et al. | 53/430 |
| 5,979,145 | A | * | 11/1999 | Louis et al. | 53/439 |
| 6,021,626 | A | * | 2/2000 | Goodman | 53/438 |

FOREIGN PATENT DOCUMENTS

| | | | | |
|---|---|---|---|---|
| FR | WO 95/02489 | | 1/1995 | |
| FR | 2 710 432 | | 3/1995 | |
| GB | 2124580 A | * | 2/1984 | 53/436 |

* cited by examiner

*Primary Examiner*—Scott A. Smith
*Assistant Examiner*—John Paradiso
(74) *Attorney, Agent, or Firm*—Dale Lischer; Herbert M. Hanegan; Eric J. Hanson

(57) ABSTRACT

Pieces (21) are cut out from a lay-up (20) built up from plies of superposed flexible sheets of material, and the lay-up is then packaged in full inside a covering (70) without separating the cutout pieces from the scrap. The lay-up can thus be transferred from a cutting installation to a workshop for assembling the pieces, and information relating to the layout or layouts of the cutout pieces can be transmitted therewith.

23 Claims, 3 Drawing Sheets

20c
20
70b
70a
80
70b
20d
70
76a
20
76b
60
72
64
74
62
66
12a
21
21
12
66a
68
49
52
58
10
14
50
40
54
Y
47
49
101
103
100
30
42
46
104
44
X
48
102
32
20
22

STORING PIECES CUT OUT FROM A LAY-UP

The present invention relates to storing pieces cut out from a lay-up made of superposed plies of flexible sheet material; in particular woven cloth.

A preferred field of application of the invention is that of the clothing industry. In this industry, production is organized in particular around a cutting workshop having at least one automatic cutting machine, and a makeup workshop where articles are assembled, stitched, and finished.

Usually, at the outlet from the cutting machine, operations are performed to separate the pieces that have been cut out from the cutting scrap (lay-up skeleton), to sort the cutout pieces and optionally to mark them, and to package the cutout pieces in packets that are coherent for the makeup workshop.

As a result packets of pieces are handled twice: once in the cutting workshop where they are packaged, and again on being received in the makeup workshop where the packaging is removed. In addition, the cost of packaging is considerable because of the large number of pieces in a lay-up.

Other problems can be encountered, such as packets of pieces becoming lost, particularly packets of smallsized pieces, and accidental breakage of packets that can lead to pieces being lost or damaged. These problems become even more worrying when, as is more and more the case, the operations of cutting-out and making-up are performed on sites that are geographically remote from each other. Thus, there are businesses that perform custom cutting for various clients who are not necessarily located nearby. The same also happens when, for reasons of labor costs, making up is performed remotely, with the cutout pieces being taken to distant countries.

An object of the invention is to solve these problems, and to this end the invention provides a method of storing pieces that have been cut out from a lay-up, in which method, once the pieces have been cut out from the lay-up, the entire lay-up is packaged, without separating the cutout pieces from the scrap.

Thus, and contrary to conventional practice, the cutout pieces are not separated from the remainder or "skeleton" of the lay-up on leaving the cutting machine. The packaged lay-up is taken to a makeup workshop so that the lay-up is taken apart on being received in the makeup workshop. The stacks of cutout pieces or "piles" are not handled twice, and the risk of loss or damage to a pile while it is being transported are eliminated.

Advantageously, the lay-up is packaged in the compressed state inside an air-tight covering, so as to reduce its size as much as possible.

Also advantageously, the lay-up is packaged inside a flexible covering which is rolled up and held in the rolled-up shape, so that the packaged lay-up can be stored and transported inside a rectangular container.

According to a feature of the method, the lay-up is associated with a data medium including at least some of the following information: information identifying the lay-up, information relating to the layout or to the layouts of the pieces cut out from the lay-up, and information relating to how the pieces are to be assembled. The information relating to the layout of pieces in the lay-up comprises information relating to the locations of the pieces and information identifying the pieces.

At least some of the information can appear on a label that is stuck to the lay-up or the covering in which it is packaged, and/or on a digital data medium such as a diskette which is packaged together with the lay-up or which is sent separately to the makeup workshop. It is also possible to use a telecommunications network to transfer digital information relating to a lay-up that has been shipped.

A particular implementation of the invention is described below by way of non-limiting indication with reference to the accompanying drawings, in which.

Figure 1:
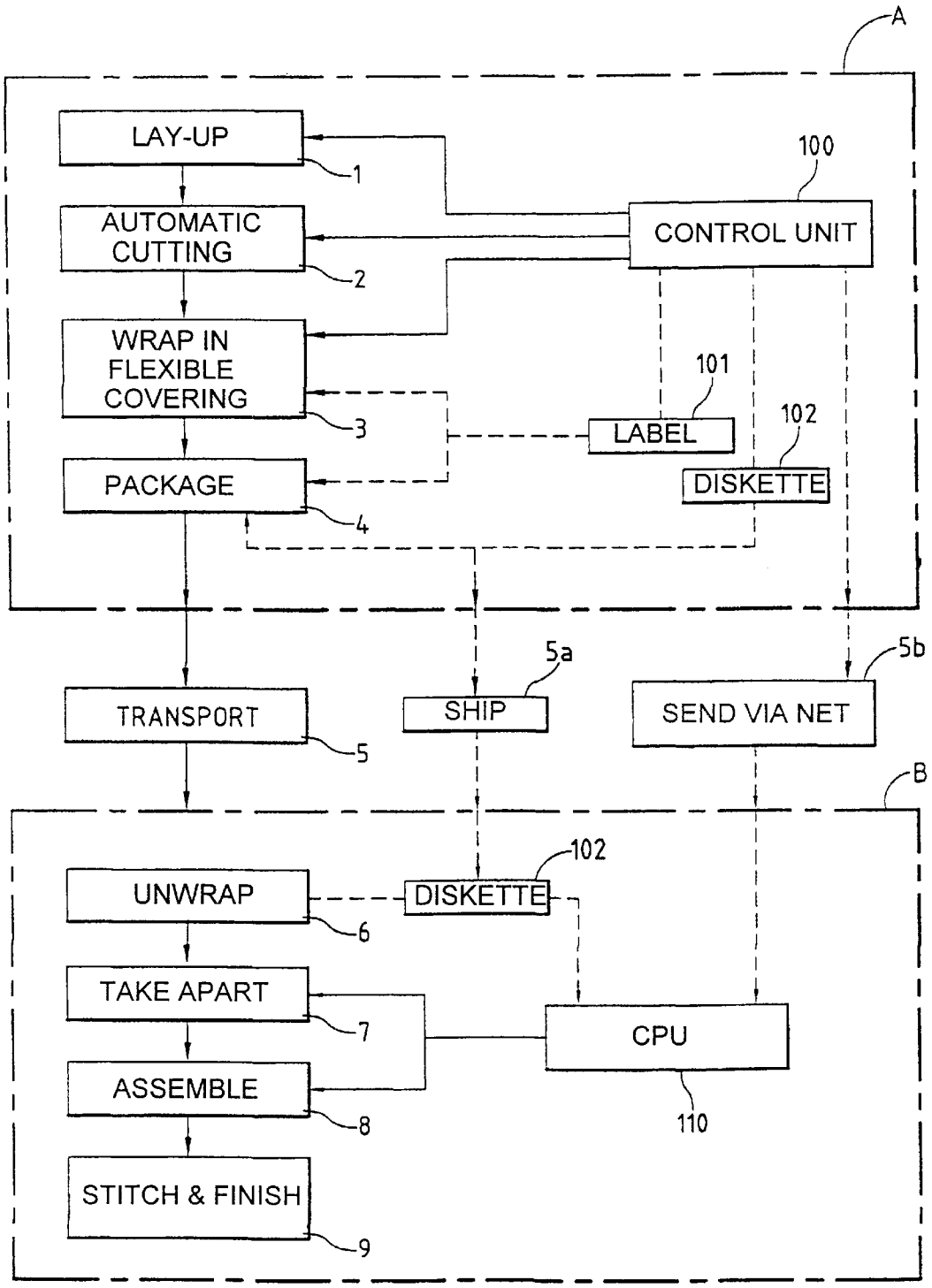
FIG. 1 is a flow chart showing the steps of a method of the invention.

References A and B in FIG. 1 respectively designate an automatic cutting-out and packaging workshop, and a making-up workshop. These workshop can be located at sites that are geographically remote from each other.

Upstream from an automatic cutting-out station, a lay-up operation 1 is performed which consists in superposing layers or plies of a flexible sheet material, e.g. plies of cloth that are to be cut simultaneously.

The lay-up obtained in this way is subjected to an automatic cutting operation 2 by means of a tool which is moved along paths that correspond to the outlines of the pieces to be cut out, with all of the pieces being cut out in full.

The cutup lay-up is packaged as a whole, without separating the pieces that have been cut out and the corresponding scrap or waste cuttings, i.e. the skeleton. Packaging 3 is performed by inserting the lay-up into a flexible covering. The covering is preferably leakproof and the lay-up is preferably compressed so as to reduce its size.

By way of example, the packaged lay-up 4 is prepared by rolling it up and holding it rolled up so as to insert it into a container of rectangular shape. The packaged lay-up can be stored and transported 5 to the makeup workshop B.

The operations of building the lay-up, automatically cutting it up, and then packaging it are performed under the control of a control unit 100. Tool displacement is controlled as a function of information stored in the control unit defining the or each layout of the pieces to be cut out from the lay-up. As is well known, layout is performed in such a manner as to minimize the amount of scrap material.

Various items of information are associated with the lay-up, for example information identifying the lay-up and its destination, information identifying the layout of the pieces, and information relating to how the pieces cut out in the lay-up are subsequently to be made up.

Information identifying the lay-up and its destination can be printed by means of the control unit 100 on one or more labels 101 that are stuck to the packaged lay-up and/or to its packaging.

Information identifying the or each layout of the pieces, such as information identifying the cutout pieces and information relating to the locations of said pieces as stored in the memory of the control unit 100 is recorded in digital form on a data medium 102, e.g. a diskette, by means of the control unit 100. Information relating to how the pieces are to be made up, for example identifying which pieces need to be assembled to one another and their relative positions, can also be recorded on the diskette 102. The diskette 102 is packaged together with the lay-up or is shipped to the makeup workshop B by any other shipping means 5*a*. In a variant, the digital information relating to the layout of the pieces and how they are to be made up can be sent to the makeup workshop B by being transmitted over a telecommunications network 5*b*.

The lay-up as received in the makeup workshop is subjected to an unpacking operation 6, and is then taken apart 7. This consists in removing the stacks or piles of cutout pieces from the remainder of the lay-up or "skeleton".

The information read from the diskette 102 or received after being transmitted over the network 5*b* is processed by a central unit 110 so that, where appropriate, it can assist operators while they are taking the lay-up 7 apart and assembling the pieces 8. Thus, each stack of pieces to be removed can be identified more easily by projecting a light onto the lay-up at the location of the stack, thereby identifying the stack and/or its location, with this being done by making use of the information relating to layout.

Another method of identifying pieces before or after they have been cut out is described in document FR-A-2 710 432.

The pieces taken from the identified stacks of pieces are made up on the basis of makeup instructions that appear in the information as received.

In a variant, the information identifying the pieces and possibly also specifying how they are to be made up, can be carried by labels put on the stacks of pieces or at the locations thereof after, during, or before automatic cutting. Labeling methods associated with automatic cutting machines or devices for building lay-ups are known, in particular from documents U.S. Pat. Nos. 4,514,246, 5,092, 829, and 5,230,765.

After being assembled, the pieces are subjected to operations 9 of stitching and finishing.

Figures 2A, 2B:
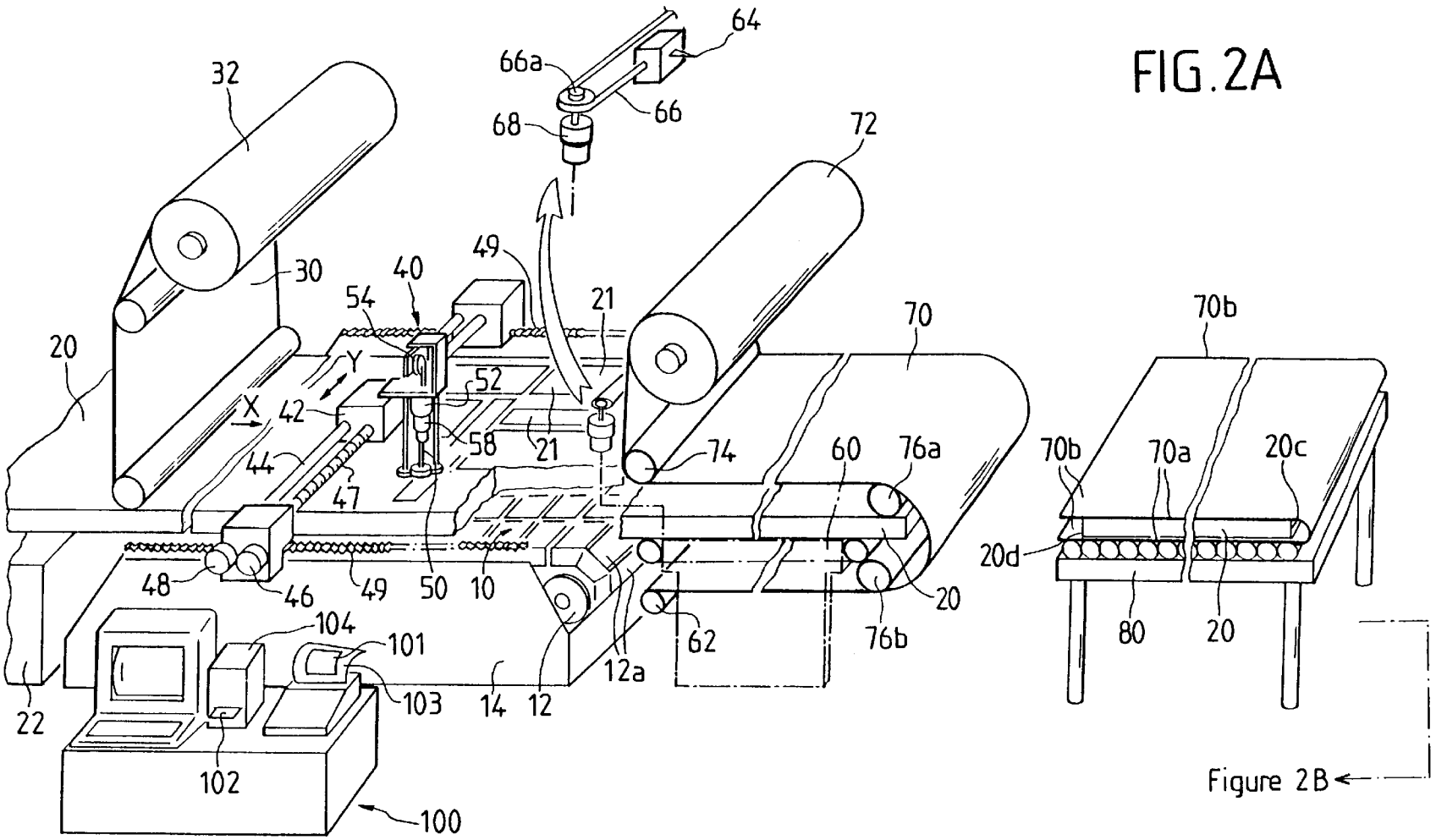
FIG. 2 (FIGS. 2A and 2B) is a perspective diagram showing a cutting machine and a packaging installation enabling the method to be implemented.
Figure 2B:
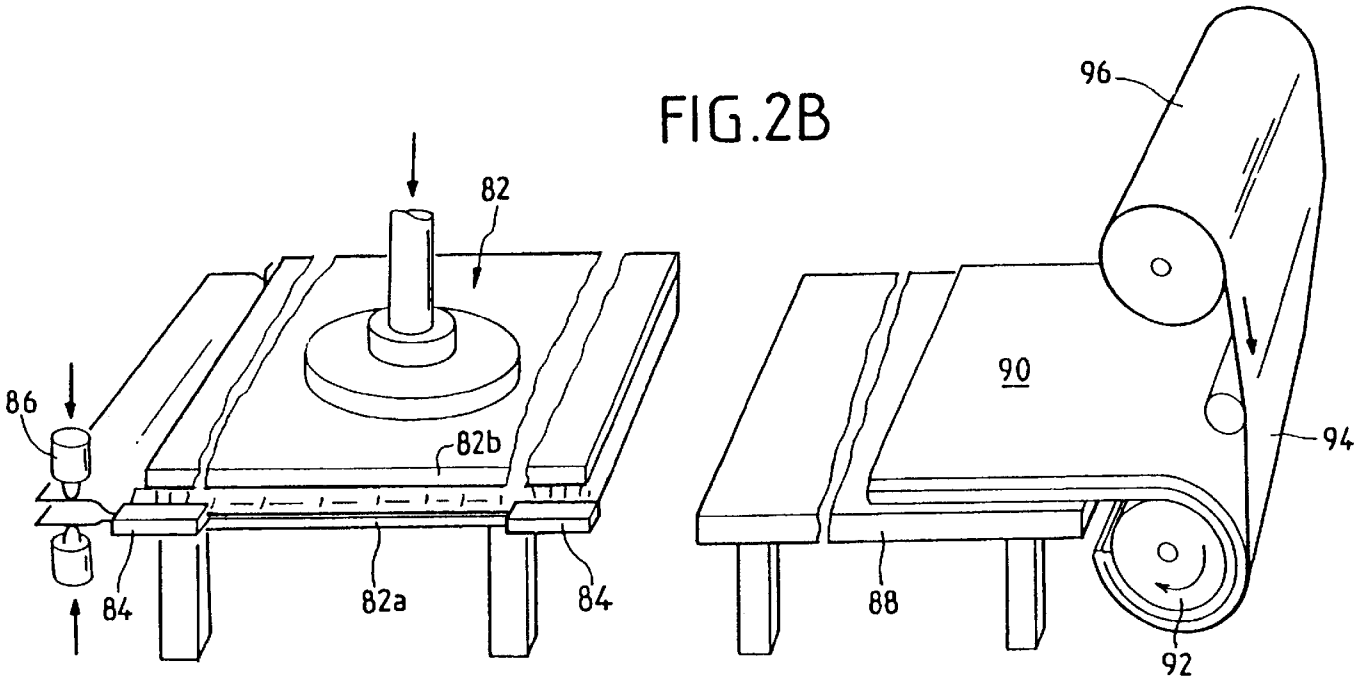

A more detailed description of a cutting machine and an installation for packaging the cut lay-up is given below with reference to FIG. 2.

The cutting machine comprises a cutting table 10 constituted by a horizontal top length of an endless conveyor 12. Apart from its top surface defining the table 10, the conveyor is housed inside a box 14. Suction means are disposed inside the box in order to establish suction therein.

The conveyor 12 is made up of support blocks 12*a* having or leaving between them passages that enable the inside of the box to communicate with surface of the table 10. The blocks which may be made of plastics material, for example, have bases from which there project a plurality of thread-like elements. As a result, a blade can penetrate into the surface of the table 10 and can move horizontally in any direction, without itself being damaged and without damaging the support blocks 12*a*.

Flexible sheet material for cutting out is brought onto the table 10 in the form of superposed plies making up a lay-up 20. The lay-up is built on a lay-up table 22 upstream from the cutting table, and it is advanced onto the cutting table in a direction X under drive from the drive motor (not shown) of the conveyor 12.

A film of air-tight plastics material 30, e.g. a film of polyethylene drawn from a roll 32, is placed on the lay-up 20 so as to cover it completely.

The lay-up 20 carried by the table 10 and covered by the film 30 is cut out by means of a cutting head 40. The cutting head can be taken to any position over the table 10 by controlling its displacement horizontally parallel to the longitudinal direction X of the conveyor 12 and in a transverse direction Y perpendicular to X.

The cutting head 40 is mounted on a block 42 which is movable in the direction Y along a transverse beam 44 under the control of a motor 46. The ends of the beam 44 are guided along the longitudinal edges of the conveyor 12 and the beam is driven in the direction X under the control of the a motor 48. The block 42 is driven in conventional manner by cables, or as shown by a wormscrew 47. The beam 44 can also be driven by means of cables or a wormscrew, or as shown, by gear wheels and racks 49, mounted in the top longitudinal edges of the box 14.

The cutting head 40 carries a cutting blade 50 that is suspended vertically beneath a rotary support 52. On top, the support 52 is fixed to the end of a connecting rod of a rod-and-crank system coupled to a motor 54 for imparting vertical reciprocating motion to the support 52 and to the blade 50. The orientation of the cutting blade 50 is controlled by a motor 58 situated beneath the support 52.

The displacement and the actuation of the cutting head 40 are under the control of a computer 100. The computer also controls advance of the conveyor 12 and the application of suction to the box 14, whereby the lay-up 20 covered in the air-tight film 30 is held securely on the table 10.

An installation of the kind described above is well known to the person skilled in the art. For example, reference can be made to document U.S. Pat. No. 3,848,490. The X,Y displacements of the cutting head are controlled so as to cut out pieces 21 (a few outlines of which are shown in FIG. 2A) in the lay-up 20 in a predetermined placement or possibly in a plurality of placements. The pieces 21 can be constituted, for example, by the component elements of garments, and their placement is determined in particular so as to minimize wastage of material. During cutting, the orientation of the cutting blade is controlled so that it remains tangential or substantially tangential to the outline of the piece being cut out. When a section of the lay-up 20 on the table 10 has been cut, together with the film 30, the conveyor 12 is caused to advance so as to bring a new section of the lay-up or a new lay-up into position. It is also possible to advance the lay-up continuously without interrupting cutting, successive lengths of the lay-up being brought onto the cutting table as the cutting operation progresses. A method enabling the layup to be advanced simultaneously with cutting taking place is described in document EP-A-0 708 700.

In accordance with the invention, means are organized downstream from the cutting table 10 to package the cut-up lay-up 20 as a whole, without separating the pieces 21 therefrom.

By way of example, packaging of the lay-up comprises the following steps:

- surrounding the lay-up in a strip of plastics film which covers each of the faces of the lay-up and one of its longitudinal ends;
- compressing the lay-up with its strip of plastics film;
- heat-sealing the strip of plastics film together along the longitudinal edges thereof;
- optionally, after further compressing the lay-up and/or placing it under vacuum, closing the ends of the strip of plastics film at the opposite longitudinal end of the lay-up so that it is packaged in sealed manner while in the compressed state; and
- rolling up the packaged lay-up so as to be able to place it inside a container of rectangular shape.

At the outlet from the cutting table 10, and in line therewith, the lay-up 20 is received on a table 60 constituted by the horizontal top portion of an endless band of a conveyor 62. So long as the lay-up 20 has not been fully extracted from the cutting table 10, the conveyor 62 can be declutched so that the lay-up 20 is not subjected to stresses as it is advanced onto the conveyor.

A flexible plastics film 70 drawn from a storage roll 72 surrounds the conveyor 62, passing over a first return roller 74 at the upstream end of the table 60, over the table, over two return rollers 76*a* and 76*b* of the downstream end of the conveyor 62, and is secured at its end to a bar 68 situated at the upstream end of the conveyor 62, and beneath it.

When the lay-up 20 has left the cutting table 10, the film 70 is cut transversely to its part between the storage roll 72 and the return rollers 74. The film can be cut manually or automatically, by means of a blade 64 mounted on a block which is secured to a cable 66 extending transversely over the path of the film 70. The cable 66 forms an endless loop passing over a drive wheel 66*a* at one end and over a return wheel (not shown) at the other end. The wheel 66*a* is driven by a reversible motor 68 so as to cause the blade 64 to describe a path extending over the entire width of the film 70 from a rest position situated on one side of the film.

After the film 70 has been cut, the conveyor 62 is driven so as to bring the lay-up onto a transfer table 80 whose surface is constituted, for example, by freely-rotatable rollers. In this position, the lay-up 20 is surrounded by a strip of plastics film which covers the top and bottom faces of the lay-up and also its downstream edge 20*c*. The strip of plastics film, which is wider than the lay-up, projects beyond each side of the lay-up along its longitudinal edges 70*a* and 70*b*. At its ends 70*d*, the strip of plastics film projects beyond the lay-up, beyond the upstream edge 20*d* thereof.

The lay-up thus surrounded by the strip of plastics film is brought between the two plates of a press 82, respectively a stationary bottom plate 82*a* and a moving top plate 82*b*. The lay-up is initially compressed by means of the press and the longitudinal edges of the strip of plastics film are heat-sealed together. Heat-sealing is performed along each side of the lay-up by means of a hot tool 84, within which the two facing portions of a longitudinal edge of the film 70 are clamped together and then bonded together.

Additional compression can then be applied to the lay-up prior to the strip of plastics film being fully closed at its ends 70*d*. This additional compression can be accompanied by being put under a vacuum, or at least a partial vacuum. The strip of plastics film is closed by heat-sealing using a hot tool 86 within which the ends 70*d* are clamped together so as to be bonded together. This provides a compressed lay-up that is packaged in sealed manner within a covering 90 formed by a flexible plastics film.

The purpose of compressing the lay-up 20 is to reduce its size, but it must not be excessive in order to avoid damaging the pieces 21.

By way of example, the plastics film can be made of polyethylene. It will be observed that in a variant the lay-up can be compressed at least in part by using a plastic film of heat-shrink material.

The packaged and compressed lay-up is removed onto a transfer table 88 from which it can be taken so as to be rolled up on a rotary mandrel 92. The lay-up is rolled up together with a supporting film 94 taken from a storage roll 96 and having one end initially fixed on the mandrel 92. The film 94 can be made of polyethylene, for example.

Figure 3:
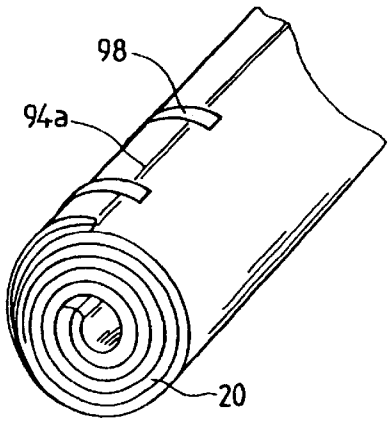
FIG. 3 is a diagrammatic view of a packaged cutout lay-up as delivered by the installation of FIG. 2.

After being rolled up, the film 94 is cut and the lay-up is held in this state, e.g. by means of adhesive tape 89 holding down the cut end 94*a* of the film 94 (FIG. 3). In this state, the lay-up can be packaged within a container of rectangular shape, e.g. a cardboard box. A label can be placed on the rolled-up lay-up and on the container, and a diskette can be packaged together with the lay-up inside the container. The label(s) is/are produced by a printer 103 associated with the control unit 100, while the diskette 102 is supplied by a disk drive 104 likewise connected to the control unit 100.

It will be observed that the above-described packaging installation is of a type that is known per se for packaging a mattress. Reference can be made in particular to document U.S. Pat. No. 4,711,067. Other packaging techniques can be used for packaging the cutout lay-up whether it is compressed or not. For example, the lay-up from the cutting table can be inserted into a sheath of flexible plastics material that can then be closed at its ends, possibly after compressing the lay-up, or while said compression is being applied by mechanical means, and/or by using a heat-shrink sheath.

What is claimed is:

1. A method of storing pieces cut from a lay-up, wherein the lay-up is formed of superposed plies of flexible sheet material and the lay-up is cut into the pieces with surrounding scrap, the method comprising the step of packaging the entire lay-up without separating the pieces from the surrounding scrap.

2. The method according to claim 1, wherein the lay-up is packaged in a compressed state inside an air-tight covering.

3. The method according to claim 2, wherein the airtight covering is a flexible covering which is rolled-up and held in the rolled-up shape.

4. The method according to claim 1, wherein the lay-up is associated with a data medium including at least some of the following information: information identifying the lay-up, information relating to a layout or layouts of the pieces cut from the lay-up, and information relating to how the pieces are to be assembled.

5. The method according to claim 4, wherein the information relating to the layout of pieces in the lay-up comprises information relating to locations of the pieces and information identifying the pieces.

6. The method according to claim 4, wherein the data medium comprises a digital data medium.

7. A method of transferring pieces cut from a lay-up from a cutting installation to a workshop for assembling the pieces, wherein the lay-up is formed of superposed plies of flexible sheet material and the lay-up is cut into the pieces with surrounding scrap, the method comprising the steps of packaging the entire lay-up without separating the pieces from the surrounding scrap, shipping the stored lay-up, and transmitting information relating to a layout or layouts of the pieces cut in the lay-up.

8. The method according to claim 7, wherein the lay-up is packaged in a compressed state inside an air-tight covering.

9. The method according to claim 8, wherein the airtight covering is a flexible covering which is rolled-up and held in the rolled-up shape.

10. The method according to claim 7, wherein the lay-up is associated with a data medium including at least some of the following information: information identifying the lay-up, information relating to a layout or layouts of the pieces cut from the lay-up, and information relating to how the pieces are to be assembled.

11. The method according to claim 10, wherein the information relating to the layout of pieces in the lay-up comprises information relating to locations of the pieces and information identifying the pieces.

12. The method according to claim 10, wherein the data medium comprises a digital data medium.

13. The method according to claim 7, wherein the information relating to the layout or layouts of the pieces cut in the lay-up is transmitted in digital form independently of the packaged lay-up.

14. A lay-up package comprising a lay-up of plies of superposed flexible sheet material including pieces that have been cut out in one or more layouts and surrounding scrap and a covering wherein the lay-up is contained within the covering without separating the pieces from the surrounding scrap.

15. The lay-up package according to claim 14, wherein the covering is air-tight and the lay-up including the pieces and surrounding scrap is stored in a compressed state inside the air-tight covering.

16. The lay-up packaged according to claim 15, wherein the lay-up package is rolled-up.

17. A method for storing pieces cut from a lay-up comprising:

a. forming a lay-up of superposed plies from a flexible sheet material;

b. cutting pieces into the superposed plies, wherein the pieces are fully detached and unseparated from the surrounding scrap;

c. packaging the lay-up of superposed plies into a package wherein the package includes the pieces and unseparated surrounding scrap.

18. The method of claim 17 further comprising covering the lay-up with a film prior to cutting pieces into the superposed plies.

19. The method of claim 17 wherein the package includes an air-tight covering.

20. The method of claim 19 wherein the package is held in a rolled-up shape.

21. The method of claim 17 further comprising associating the lay-up with a data medium, the data medium including information relating to how the pieces are to be assembled.

22. The method of claim 17 further comprising associating the lay-up with a data medium, the data medium including information identifying the lay-up.

23. The method of claim 17 further comprising associating the lay-up with a data medium, the data medium including information relating to a layout or layouts of the pieces cut from the lay-up.

* * * * *